US012405035B1

(12) United States Patent
Primbas

(10) Patent No.: US 12,405,035 B1
(45) Date of Patent: Sep. 2, 2025

(54) AIR CONDITIONING SYSTEM AND TRANSPORTATION SYSTEM INCLUDING SAME

(71) Applicant: Thevu LLC, Concord Township, OH (US)

(72) Inventor: George Primbas, Concord Township, OH (US)

(73) Assignee: THEVU LLC, Concord Township, OH (US)

( * ) Notice: Subject to any disclaimer, the term of this patent is extended or adjusted under 35 U.S.C. 154(b) by 0 days.

(21) Appl. No.: 19/171,566

(22) Filed: Apr. 7, 2025

Related U.S. Application Data

(63) Continuation-in-part of application No. 19/003,031, filed on Dec. 27, 2024, which is a continuation of application No. 18/816,006, filed on Aug. 27, 2024, now Pat. No. 12,215,908, which is a continuation-in-part of application No. 18/612,010, filed on Mar. 21, 2024, now Pat. No. 12,103,354.

(60) Provisional application No. 63/559,466, filed on Feb. 29, 2024.

(51) Int. Cl.

| | |
|---|---|
| ***F25B 9/06*** | (2006.01) |
| ***F24F 5/00*** | (2006.01) |
| ***F25B 43/00*** | (2006.01) |
| *F25B 9/00* | (2006.01) |

(52) U.S. Cl.
CPC ..... *F25B 9/06* (2013.01); *F24F 5/0085* (2013.01); *F25B 43/00* (2013.01); *F25B 9/004* (2013.01)

(58) Field of Classification Search
CPC ..... F24F 5/0085; F25B 9/004; F25B 43/00; F25B 9/06
See application file for complete search history.

(56) References Cited

U.S. PATENT DOCUMENTS

| | | | |
|---|---|---|---|
| 2,304,151 | A | 12/1942 | Crawford |
| 2,800,002 | A | 7/1957 | Seed |
| 4,546,939 | A | 10/1985 | Cronin |
| 4,550,573 | A | 11/1985 | Rannenberg |
| 5,036,678 | A | 8/1991 | Renninger et al. |
| 5,317,904 | A | 6/1994 | Bronicki |

(Continued)

OTHER PUBLICATIONS

Green Car Congress, "Aeristech launches new 48V electric supercharger," Jul. 31, 2015, pp. 1-17.

(Continued)

*Primary Examiner* — Filip Zec
(74) *Attorney, Agent, or Firm* — The Powers IP Law Firm

(57) ABSTRACT

An air conditioning system includes a rotation driving device, an energy storage device for powering the rotation driving device, a generator electrically connected to the energy storage device, and a turboexpander. The turboexpander includes a drive shaft coupled to both the generator and the rotation driving device, and configured to be rotated by the rotation driving device. The turboexpander also includes a compressor wheel and an expander wheel. The compressor wheel is configured to pull in ambient air and generate pressurized air from the ambient air responsive to rotation of the drive shaft. The expander wheel is fluidly coupled to the compressor wheel such that the pressurized air from the compressor wheel is configured to be received in the expander wheel and converted into expanded and cooled air by the expander wheel for delivery to an environment.

17 Claims, 5 Drawing Sheets

(56) References Cited

U.S. PATENT DOCUMENTS

| | | | | |
|---|---|---|---|---|
| 5,701,755 | A | 12/1997 | Severson et al. | |
| 5,709,103 | A | 1/1998 | Williams | |
| 5,722,229 | A | 3/1998 | Provost | |
| 6,526,775 | B1 | 3/2003 | Asfia et al. | |
| 6,735,951 | B2 | 5/2004 | Thompson | |
| 7,222,499 | B2 | 5/2007 | Hunt | |
| 7,871,038 | B2 | 1/2011 | Space et al. | |
| 8,935,928 | B2 | 1/2015 | Mills | |
| 9,464,638 | B2 | 10/2016 | Cepeda-Rizo et al. | |
| 9,650,941 | B2 | 5/2017 | Zhou | |
| 9,656,756 | B2 * | 5/2017 | Atkey | F02C 7/32 |
| 9,897,336 | B2 * | 2/2018 | Staffend | F01K 23/06 |
| 9,926,936 | B2 * | 3/2018 | Crisp | F04D 25/024 |
| 10,611,487 | B2 * | 4/2020 | Behrens | B64D 13/06 |
| 11,142,040 | B2 * | 10/2021 | Pursifull | B60H 1/143 |
| 11,535,392 | B2 * | 12/2022 | LaTulipe | B64D 27/33 |
| 11,603,795 | B2 | 3/2023 | Katsumata et al. | |
| 11,761,378 | B2 | 9/2023 | Klemen et al. | |
| 11,802,489 | B1 | 10/2023 | Spierling | |
| 2007/0205297 | A1 | 9/2007 | Finkam et al. | |
| 2011/0239659 | A1 | 10/2011 | Lior | |
| 2017/0057641 | A1 * | 3/2017 | Koerner | F25B 25/005 |
| 2018/0340713 | A1 | 11/2018 | Dowdy, III | |
| 2019/0309997 | A1 | 10/2019 | Fletcher et al. | |
| 2020/0189397 | A1 * | 6/2020 | Mangum | H02J 7/14 |
| 2023/0036416 | A1 | 2/2023 | Desantes et al. | |

OTHER PUBLICATIONS

Duryea Technologies, "Duryea 12 Volt Electric Supercharger," 2025, pp. 1-6.

Design News, "How Garrett Motion's E-Turbos Leapt From the Race Track to the Showroom," Feb. 17, 2023, pp. 1-9.

International Search Report and Written Opinion received in PCT/US2025/010562 dated Mar. 4, 2025, pp. 7.

* cited by examiner

AIR CONDITIONING SYSTEM AND TRANSPORTATION SYSTEM INCLUDING SAME

CROSS REFERENCE TO RELATED APPLICATIONS

This application is a continuation-in-part of U.S. patent application Ser. No. 19/003,031, filed Dec. 27, 2024, and entitled "AIR CONDITIONING SYSTEM AND TRANSPORTATION SYSTEM INCLUDING SAME", which is a continuation of U.S. patent application Ser. No. 18/816,006, filed Aug. 27, 2024, now U.S. Pat. No. 12,215,908, and entitled "AIR CONDITIONING SYSTEM AND TRANSPORTATION SYSTEM INCLUDING SAME", which is a continuation-in-part of U.S. patent application Ser. No. 18/612,010, filed Mar. 21, 2024, now U.S. Pat. No. 12,103,354, and entitled "AIR CONDITIONING SYSTEM, TRANSPORTATION SYSTEM INCLUDING THE SAME, AND ASSOCIATED METHOD", which claims priority to and claims the benefit of U.S. Patent Application Ser. No. 63/559,466, filed Feb. 29, 2024, the contents of which are incorporated herein in by reference.

BACKGROUND

Air conditioning (A/C) systems have been known for many years. Generally, it can be said that A/C systems provide cooled air into an environment (e.g., a residential or commercial building) by removing heat from indoor air. As the A/C system is performing this function, it returns the cooled air to the indoor space, and expels hot air outside of the building. Today, known A/C systems use a coolant, such as freon, ammonia, propane, and the like, and circulates this coolant to generate the cooled air. Furthermore, today's A/C systems, such as the prior art A/C system 2 of FIG. 1, include a compressor 4, a condenser 6, and an evaporator 8. In operation, these components of the A/C system work to change the coolant from gas to liquid and back to a gas.

More specifically, the compressor 4 increases the pressure and temperature of the coolant gas and delivers it to the condenser 6, where it is converted to a liquid, before it is sent back to the evaporator 8. In the evaporator 8, the liquid coolant (e.g., freon, ammonia etc.) evaporates and cools the coil of the evaporator 8. Subsequent to this cooling of the coil of the evaporator 8, a fan 10 blows air across the cold coil of the evaporator 8 in order to cool the building (e.g., residence, commercial, or otherwise). Additionally, after being blown into the building, the cooled air is then circulated throughout the building while the heated evaporated gas is sent back outside the compressor. In other words, the A/C system 2 is a closed loop system, and as such, the heat is then released into the outdoor air as the coolant returns to a liquid state. In operation, this sequence is repeated until the building reaches a desired temperature.

The above-described system/process has a number of drawbacks. First, coolant in A/C systems, such as freon (e.g., refrigerant), is becoming more and more regulated. As a result, the coolant is becoming extremely expensive and inefficient for users, who may be homeowners or commercial building owners, to use in their A/C systems. Second, performing maintenance on today's A/C systems is rather difficult. For example, maintenance technicians who have to replace coolant of a given A/C system with new coolant are forced to turn off an entire A/C system, syphon out the old coolant, and introduce the new coolant. This process can take significant time to perform, costing users money. Third, because the cost of various coolants has gotten so high, owners are often forced to replace entire A/C systems when they have leaks in their coils, rather than simply introduce new coolant. This is not desirable. Fourth, because coolant and today's A/C systems (e.g., evaporators and condensers) are so expensive, many places in the world, such as hot desert regions, are unable to afford the same, thereby making withstanding the heat rather difficult. Fifth because powering air compressors requires users to draw power from a power grid, regions of the world with less sophisticated electric power capabilities are undesirably deprived of air conditioning. Finally, because today's A/C systems are closed loop systems, users are forced to keep their windows and doors closed, in order to prevent cooled air from escaping, and/or to minimize A/C bills.

Other systems which cause gases to move between states, besides the A/C system 2, include air separation systems at air separation plants. These systems have been known for a long time. However, the primary purpose of most all if not all air separation systems at these plants is to liquify gases (e.g., nitrogen, oxygen, etc.) for refrigeration purposes. Accordingly, equipment in these plants is uniquely tailored for the purpose of, for example, liquifying oxygen and nitrogen. Furthermore, gases in such plants, such as nitrogen gas, are lethal if breathed in by a human.

It is with respect to these and other considerations that the instant disclosure is concerned.

SUMMARY

In one aspect of the disclosed concept, an air conditioning system is provided. The air conditioning system comprises a rotation driving device; an energy storage device for powering the rotation driving device; a generator electrically connected to the energy storage device; and a turboexpander, comprising: a drive shaft coupled to both the generator and the rotation driving device, and configured to be rotated by the rotation driving device, a compressor wheel coupled to the drive shaft and configured to pull in ambient air and generate pressurized air from the ambient air responsive to rotation of the drive shaft in a manner wherein the rotation driving device provides a source of kinetic energy to cause the compressor wheel to rotate and generate the pressurized air, and an expander wheel coupled to the drive shaft and fluidly coupled to the compressor wheel such that the pressurized air from the compressor wheel is configured to be received in the expander wheel and converted into expanded and cooled air by the expander wheel for delivery to an environment. The expander wheel and the generator are configured to convert both the source of kinetic energy and energy in the ambient air into mechanical energy of the drive shaft, and then convert the mechanical energy of the drive shaft into electrical energy in the generator for charging the energy storage device, and thereby powering the rotation driving device.

In another aspect, a transportation system comprises an electric motor; at least one element coupled to and configured to be driven by the electric motor in order to move the transportation system between an IDLING state corresponding to the transportation system being turned on and not moving, and an OPERATING state corresponding to the transportation system being turned on and moving; and air conditioning system, comprising a rotation driving device, an energy storage device for powering the rotation driving device and the electric motor, a generator electrically connected to the energy storage device, and a turboexpander, comprising a drive shaft coupled to both the generator and the rotation driving device, and configured to be rotated by the rotation driving device, a compressor wheel coupled to the drive shaft and configured to pull in ambient air and generate pressurized air from the ambient air responsive to rotation of the drive shaft in a manner wherein the rotation driving device provides a source of kinetic energy to cause the compressor wheel to rotate and generate the pressurized air, and an expander wheel coupled to the drive shaft and fluidly coupled to the compressor wheel such that the pressurized air from the compressor wheel is configured to be received in the expander wheel and converted into expanded and cooled air by the expander wheel for delivery to an environment. The expander wheel and the generator are configured to convert both the source of kinetic energy and energy in the ambient air into mechanical energy of the drive shaft, and then convert the mechanical energy of the drive shaft into electrical energy in the generator for charging the energy storage device, and thereby powering the rotation driving device.

In another aspect, a transportation system comprises an electric motor; at least one element coupled to and configured to be driven by the electric motor in order to move the transportation system between an IDLING state corresponding to the transportation system being turned on and not moving, and an OPERATING state corresponding to the transportation system being turned on and moving; and an air conditioning system, comprising a rotation driving device, an energy storage device for powering both the rotation driving device and the electric motor, a generator electrically connected to the energy storage device, and a turboexpander, comprising a drive shaft coupled to both the generator and the rotation driving device, and configured to be rotated by the rotation driving device, a compressor wheel coupled to the drive shaft and configured to pull in ambient air and generate pressurized air from the ambient air responsive to rotation of the drive shaft in a manner wherein the rotation driving device provides a source of kinetic energy to cause the compressor wheel to rotate and generate the pressurized air, and an expander wheel coupled to the drive shaft and fluidly coupled to the compressor wheel such that the pressurized air from the compressor wheel is configured to be received in the expander wheel and converted into expanded and cooled air by the expander wheel for delivery to an environment. The expander wheel and the generator are configured to convert both the source of kinetic energy and energy in the ambient air into mechanical energy of the drive shaft, and then convert the mechanical energy of the drive shaft into electrical energy in the generator for charging the energy storage device, and thereby powering the rotation driving device.

DETAILED DESCRIPTION

Figure 1:
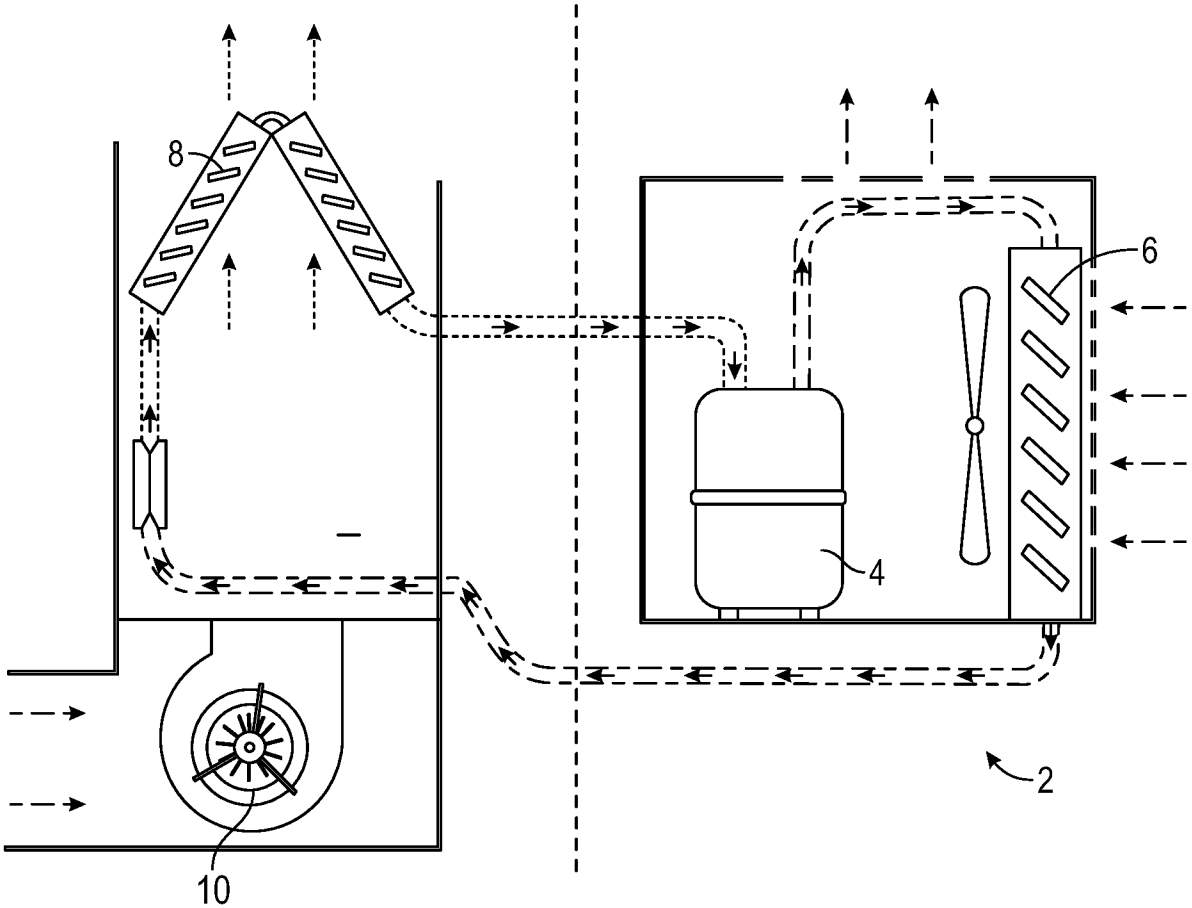
FIG. 1 (Prior Art)
FIG. 1 is a schematic of a prior art A/C system.

As employed herein, the term "coupled" shall mean connected together either directly or via one or more intermediate parts or components.

As employed herein, the term "number" shall mean one or an integer greater than one (i.e., a plurality).

As employed herein, the term "air compressor" shall mean a device which generates pressurized air from ambient air, and delivers the pressurized air at an outlet at a pressure greater than the pressure of the ambient air entering the inlet. Air compressors in accordance with the disclosed concept may use electrical energy in order to generate a flow of pressurized gas. Air compressors may include an electric air compressor motor. Air compressors in accordance with the disclosed concept, unlike nitrogen compressors (or compressors configured for other gases besides air), may not have gas coolers, inlet and outlet dampers, and asynchronous motors.

As employed herein, the term "blower" shall mean an apparatus configured to produce air movement to a space.

As employed herein, the term "generator" shall mean a device configured to convert mechanical energy obtained from an external source into electrical energy as an output. Generators in accordance with the disclosed concept may convert mechanical energy from rotation of a drive shaft of a turboexpander into electrical energy, and may do so by moving at least one electrical conductor in a magnetic field in order to create a voltage difference between two ends of the electrical conductor.

As employed herein, the term "coolant" shall mean a substance configured to change states between liquid and gas, and as employed in a coil of an evaporator of an A/C system, such as the A/C system 2. Non-limiting examples of coolants include freon, propane, and ammonia.

As used herein, the term "air" shall mean an atmospheric gas comprised of Nitrogen, Oxygen, and Argon. Air in accordance with the disclosed concept preferably includes indoor and outdoor air, as well as both purified and non-purified air, wherein purified air includes, but is not limited to, air in which moisture and/or carbon dioxide have been removed. In one non-limiting example, air in accordance with the disclosed concept is non-toxic (e.g., breathable) to human beings.

As employed herein, the term "valve" shall mean a device for causing an opening area of a region of a conduit to be changeable as the valve opens and closes. Valves in accordance with disclosed concept may include guide vanes, as well as devices which move between FULLY OPEN states and FULLY CLOSED states.

As employed herein, the terms "inlet" and "outlet" shall each correspond to a "conduit", whether a metallic or non-metallic pipe, or other type of conduit.

As employed herein, the term "control system" shall mean a system for directing the flow of air in an air conditioning system by causing any number of valves to independently move to predetermined positions, including fully open positions, fully closed positions, and positions therebetween. Control systems in accordance with the disclosed concept include programmable logic control systems.

As employed herein, the phrase "combustion reaction involving burning of fuel" shall mean a reaction involving an explosion between a gas, such as air, and a combustible fuel (e.g., oil including byproducts such as gasoline and aviation fuel, and natural gas including byproducts such as hydrogen fuel). A "combustion reaction involving burning of fuel" does not include the discharge of energy from an energy storage device such as a battery, and associated powering of an air compressor motor therewith.

As employed herein, the phrase "sole source of kinetic energy" shall mean a source of kinetic energy, such as a flow of pressurized air, in whose absence another object, such as a compressor wheel of a turboexpander, is configured to be in a static state (e.g., at rest), with respect to a ground.

As employed herein, the term "turboexpander" shall mean a device comprising a drive shaft, and first and second wheels coupled to the drive shaft, wherein the first wheel is configured to compress a gas and the second wheel is configured to expand the gas.

Figure 2:
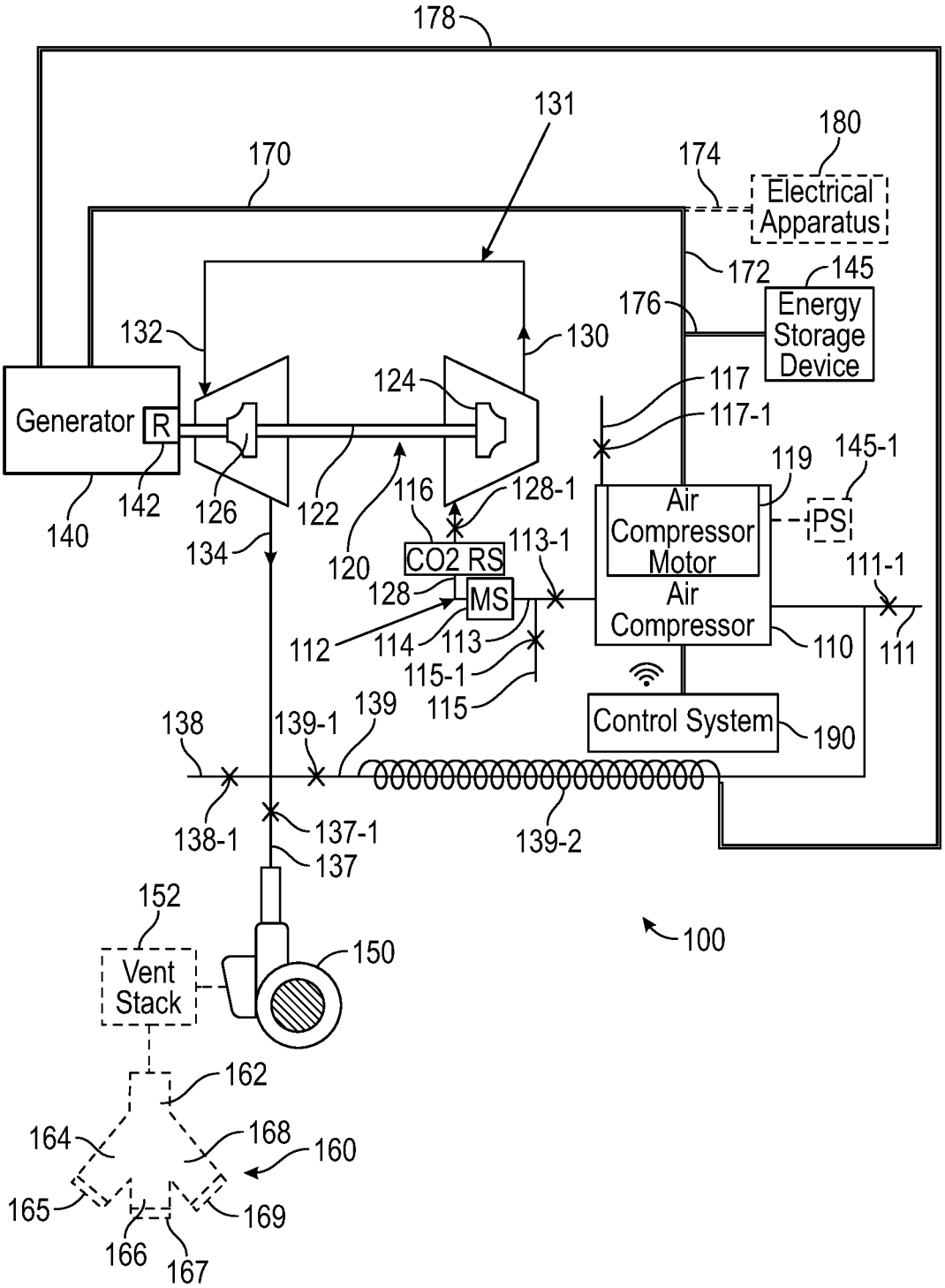
FIG. 2 is a simplified view of an A/C system in accordance with the disclosed concept, shown as employed with an electrical apparatus, an additional power source, a vent stack, and ductwork, each of which is illustrated in dashed line drawing, and wherein double line connections between components in FIG. 2 denote electrical connections and single line connections between components in FIG. 2 generally denote conduits (e.g., without limitation, pipes) through which fluids may flow.

FIG. 2 shows an example A/C system 100, in accordance with one non-limiting embodiment of the disclosed concept. The A/C system 100 in one example is preferably a coolant-free air conditioning system such that it functions without circulating coolant into a coil of an evaporator or other device. This is highly beneficial, as compared to the A/C system 2 (FIG. 1), which is required to use coolant to cool buildings and the like. More specifically, by being coolant-free, the A/C system 100 can, among other advantages, save users money and minimize maintenance. That is, large evaporators and the like do not have to be replaced, and expensive coolant does not have to be employed in order to cool a building.

The A/C system 100 will now be discussed in detail, and the aforementioned advantages as well as others will be made apparent. As shown in FIG. 2, the system 100 includes an air compressor 110, a turboexpander 120, a generator 140 coupled to the turboexpander 120, an energy storage device 145 (e.g., without limitation, a battery, a capacitor, or another different type of energy storage device) electrically connected to the generator 140, and a blower 150. The turboexpander 120 is coupled to the air compressor 110, the generator 140, and the blower 150. In one non-limiting example, the A/C system 100 is configured to deliver expanded and cooled air to ductwork 160, which may be coupled to the blower 150 and configured to deliver the expanded and cooled air from the turboexpander 120 throughout a building.

In operation, aspects of the A/C system 100 comprising the air compressor 110, the turboexpander 120, the generator 140, the energy storage device 145, and the blower 150 may be located outside of a building, and may be fluidly coupled to the ductwork 160, which may extend throughout the interior of the building. In a suitable alternative example, the air compressor 110, the turboexpander 120, the generator 140, and the blower 150 may all be located in an interior of a building and be a self-contained subassembly that is configured to pull indoor air into the air compressor 110 for cooling, wherein the cooled air may be delivered back into the indoor environment.

The turboexpander 120 includes a drive shaft 122, a compressor wheel 124 coupled to the drive shaft 122, an expander wheel 126 coupled to the drive shaft 122 and the compressor wheel 124 (e.g., via the drive shaft 122), a first inlet 128 and a first outlet 130 each associated with the compressor wheel 124, and a second inlet 132 and a second outlet 134 each associated with the expander wheel 126. Furthermore, as shown, the generator 140 includes a rotor ("R") 142 coupled to the drive shaft 122 of the turboexpander 120 and configured to be rotated during operation of the turboexpander 120.

Moreover, the air compressor 110 may include an air compressor motor 119, which may be an electric motor. Additionally, the generator 140 is preferably electrically connected to the air compressor motor 119 in order to power the air compressor 110, and/or is configured to be electrically connected to an electrical apparatus 180 (shown in dashed line drawing in FIG. 2) in order to power the electrical apparatus 180. The electrical apparatus 180 may be an operating system of a building (e.g., a restaurant, hospital, and the like), such as a lighting system, refrigeration system, freezer system, etc., in a manner wherein the A/C system 100 is configured to deliver air conditioning to the building, and also supply power to the lighting, refrigeration, and/or freezer system, as well as various other systems within the building. Furthermore, the generator 140 may be configured to power, e.g., fully power, the electrical apparatus 180 (e.g., the operating system of the building) while the blower 150 is delivering the expanded and cooled air to the building. After discussion of the operation of the A/C system 100, below will be discussion of an example implementation of the A/C system 100, wherein an electrical apparatus is in the form of an electric motor 280 (FIG. 4) of a transportation system (e.g., vehicle 200, shown in FIGS. 3 and 4), such that the vehicle 200 includes the A/C system 100 as an integral operating system.

Continuing to refer to FIG. 2, the energy storage device 145 is electrically connected to the air compressor motor 119, the generator 140, and the electrical apparatus 180. Additionally, in non-limiting examples of the disclosed concept, the A/C system 100 does have the capability to receive power from a grid (e.g., from a power source 145-1, shown in dashed line drawing in FIG. 2), should the need arise.

In operation, the generator 140 reliably supplies power to a number of devices. For example, the energy storage device 145 is electrically connected to and configured to be charged by the generator 140 of the A/C system 100. Moreover, the energy storage device 145 is also configured to power the air compressor motor 119. Specifically, during operation of the A/C system 100, power may first be drawn by the air compressor motor 119 from the energy storage device 145.

In one non-limiting example, the A/C system 100 further includes a moisture separator ("MS") 114, which may be a filter, fluidly coupled to an outlet 113 of the air compressor 110 and the first inlet 128 of the turboexpander 120 in order for moisture (e.g., water) to be removed from the pressurized air before the pressurized air is delivered to the turboexpander 120. As such, the air compressor 110 may be configured to pull in ambient air at an inlet 111 of the air compressor 110 from the atmosphere, generate pressurized air from the ambient air, and cause the pressurized air to exit via the outlet 113 before being passed through the moisture separator 114. It will be appreciated that the ambient air may be pressurized to any number of different pressure ranges, depending on the environment for the A/C system 100. In one example, the ambient air is pressurized to between 130-180 psi. In an alternative example, an air compressor is configured to generate higher or lower pressures higher than 130-180 psi, provided suitable materials are employed, such as thicker and higher-grade steels for higher pressures.

Continuing to refer to FIG. 2, it will be appreciated that the air compressor 110 may, in one example, be fluidly coupled to the turboexpander 120 without any intermediate air processing apparatuses (e.g., a heat exchanger, distillation column, etc.) therebetween, such that the pressurized air flows directly from the air compressor 110 into the turboexpander 120. As used herein, the moisture separator 114 is not considered an air processing apparatus. In a further example, the outlet 113 of the air compressor 110 is directly coupled to and engaged with the first inlet 128, such that air flows directly from the outlet 113 through the moisture separator 114 and into the first inlet 128 of the turboexpander 120, without passing through any other intermediate parts or components. It will also be appreciated that the blower 150 may be fluidly coupled to the second outlet 134 without any intermediate air processing apparatuses (e.g., a heat exchanger, distillation column, etc.) being located therebetween. In other words, the blower 150 may have an inlet 137 that is directly coupled with and engaged with the second outlet 134.

In one example, a suitable alternative air compressor (not shown) may be fluidly coupled to the first inlet 128 of the turboexpander via a side stream 115, shown in FIG. 2. In such an embodiment, the alternative air compressor (not shown) may be an existing air compressor at a garage, air separation facility, or the like. In such an example embodiment of the disclosed concept, the side stream 115, and a valve 115-1 coupled to the side stream 115, may be one of a plurality of streams of the air compressor (not shown), wherein other of the streams may separately be configured to be directed to, for example, a fork-lift (not shown) in a garage or other location. Accordingly, it will be appreciated that air from the alternative air compressor (not shown) may likewise not be processed (e.g., in a heat exchanger, distillation column, or the like) when passing through the valve 115-1 of the side stream 115 to the first inlet 128. Furthermore, in such an example of the disclosed concept, an air conditioning system preferably includes the turboexpander 120, the generator 140, the energy storage device 145, and the blower 150, which are configured to receive the pressurized air from the separate air compressor (not shown) via the side stream 115 and valve 115-1.

Continuing to refer to FIG. 2, coupled to the outlet 113 of the air compressor 110 is a valve 113-1, and coupled to the first inlet 128 of the turboexpander 120 is another valve 128-1. In operation, the valves 113-1,128-1 function to control the volume and speed of air both exiting the air compressor 110 and entering the first inlet 128 of the turboexpander 120. As a result, volume flow of air moving through the A/C system 100 is configured to be reliably controlled by opening and closing the valves 113-1,128-1.

More specifically, the A/C system 100 may further include a control system 190. In one example, the control system 190 is wirelessly connected and/or electrically connected to the air compressor 110 and the valves 113-1,128-1, such that responsive to actuation of the control system 190 (e.g., wherein a user presses a button on a control panel or sends a signal to the control system 190 with a wireless device), the air compressor 110 is configured to generate the pressurized air at a predetermined first pressure, thereby causing the turboexpander 120 to generate expanded and cooled air at a predetermined second temperature. This is achieved by the valves 113-1,128-1 being opened and closed to predetermined opening areas by the control system 190.

Once inside the turboexpander 120, the compressor wheel 124 may generate boosted air from the pressurized air from the air compressor 110, and the expander wheel 126 may generate expanded and cooled air from the boosted air, as will be discussed below. For example, the compressor wheel 124 boosts the pressurized air from the air compressor 110 to an even greater pressure. As such, by employing the compressor wheel 124, a size of the air compressor 110 is advantageously able to be relatively small. In one example, the compressor wheel 124 receives the pressurized ambient air at 130-180 psi and boosts the pressurized ambient air to a pressure even greater than 180 psi. After being boosted by the compressor wheel 124, the even higher pressurized air exits the compressor wheel 124 via the first outlet 130, which is fluidly coupled to the second inlet 132 of the expander wheel 126.

Accordingly, after exiting through the first outlet 130, the boosted air enters the expander wheel 126 via the second inlet 132. Once inside the expander wheel 126, the boosted air is expanded by volume, which causes a relatively large pressure and temperature drop in the air. In other words, the expander wheel 126 generates expanded and cooled air from the boosted air. In one example, the air is configured to exit the turboexpander at between 3-20 psi of pressure, as well as between 33-45 degrees Fahrenheit. It will be appreciated that inlet and outlet temperatures associated with the turboexpander 120 may readily be varied.

However, in accordance with the disclosed concept, air is preferably not being liquified during operation of the A/C system 100 (e.g., other than at the moisture separator 114), and operation of the A/C system 100 includes directing the air above a freezing temperature of water. That is, the air compressor 110 and the turboexpander 120 are together configured to change the ambient air to the expanded and cooled air without causing any of the ambient, pressurized, boosted, and expanded and cooled air to change states between a gas and a liquid. This includes embodiments where air undergoes a purification process corresponding to moisture and carbon dioxide being removed from the air between the air compressor 110 and the first inlet 128.

Furthermore, it will be appreciated that the gas which is compressed by the air compressor 110 and the compressor wheel 124, and then expanded and cooled by the expander wheel 126, is the same gas which is delivered to the blower 150. That is, unlike existing systems (e.g., the A/C system 2) in which coolant changes from liquid to gas in the evaporator in order to cool an entirely separate and distinct gas (e.g., air) which is passed over the coil of the evaporator, the A/C system 100 is preferably coolant-free. As such, the same air which is pressurized, boosted, and expanded and cooled is also the air that is delivered to the blower 150, such that the blower receives the expanded and cooled air in order to deliver the expanded and cooled air to an environment. Put another way, substantially all of the air associated with the A/C system 100 enters and passes through each of the compressor 110, the turboexpander 120, and the blower 150 such that coolant (e.g., being located in coils) is preferably not employed to cool the air. As such, the A/C system 100 readily provides tremendous advantages over the prior art A/C system 2 (FIG. 1) and improves over the prior art A/C system 2 in most and/or all of the respects discussed above in connection with the A/C system 2 (FIG. 1).

Continuing to refer to FIG. 2, as the expander wheel 126 is dropping the pressure and temperature of the air, the drive shaft 122 is rotating, which in turn powers the windings of the generator 140 via the coupling between the rotor 142 and the drive shaft 122. The purpose of this functionality will be described below. Additionally, once the pressure and temperature of the air have been dropped by the expander wheel 126, the expanded and cooled (e.g., and also low pressure)

air is caused to exit the turboexpander 120 via the second outlet 134. In turn, this cool and low-pressure air is advantageously used to cool a building, the cabin of the vehicle 200 (FIGS. 3 and 4), and/or other environments. More specifically, and continuing to refer to FIG. 2, the inlet 137 of the blower 150 is fluidly coupled to the second outlet 134. As such, when the cool and low-pressure air is received at the blower 150, a fan of the blower 150 can cause that cool and low-pressure air to be excited (e.g., made more turbulent), thereby allowing it to be delivered more effectively to a building.

Furthermore, because the air is rather cold, in one example the A/C system 100 is configured to be employed with a valve system in the form of a vent stack 152 coupled to the outlet of the blower 150. The vent stack 152 may open and close to an outside environment automatically or from a user. In one example, the control system 190 is wirelessly connected to the vent stack 152 in order to better control the temperature of cooled air being delivered to a building. For example, a smaller opening of the vent stack 152 via the control system 190 is configured cause colder temperatures in a given building. Accordingly, the vent stack 152 may be a way for the A/C system to regulate temperature in a building. In one example, the vent stack 152 could be open one at an initial time one hundred percent and then can close in a gradual manner in order to efficiently regulate temperature in a building.

Continuing to refer to FIG. 2, the ductwork 160, which is coupled to the A/C system 100, may include a primary branch 162 and a plurality of secondary branches 164,166, 168 fluidly coupled to the primary branch 162. Additionally, coupled to, located on, and/or provided with an end of each of the secondary branches 164,166,168 may be a corresponding vent 165,167,169 (e.g., one which may be positioned adjacent a wall of a room of a commercial building or house). As such, it will be appreciated that the cool and low-pressure air, which has been excited by the blower 150, will enter the primary branch 162 (e.g., the primary branch 162 is fluidly coupled to the blower 150) and be forced through each of the secondary branches 164,166,168, where it will exit the ductwork 160 through the corresponding vents 165,167,169, thereby adequately delivering the cooled and low-pressure air throughout a large number of regions of a building.

In addition to delivering cooled and low-pressure air to an environment, the A/C system 100 is also provided with a power generation capability in tandem with the air conditioning capability. More specifically, as stated above, as the drive shaft 122 of the turboexpander 120 is caused to rotate, the rotor 142 of the generator 140 is rotated, thus generating power. As shown in FIG. 2, a first electrical line 170 is electrically connected to the generator 140, and a number of branch electrical lines 172,174,176 are each directly or indirectly electrically connected to the first electrical line 170. In one example, the electrical lines 170,172,174,176 allow electrical power from the generator 140 to be directed to any combination or all of the air compressor motor 119, the energy storage device 145, and the electrical apparatus 180.

In one example, electric power from the generator 140 is directed back into the air compressor motor 119 via the electrical lines 170,172, which may be one single electrical line. In another example, the A/C system 100 further is configured to deliver power to the electrical apparatus 180, wherein electric power from the generator 140 is directed to the electrical apparatus 180 via the electrical lines 170,174, which may be one single electrical line. In yet a further example, electric power from the generator 140 is directed to the energy storage device 145 via the electrical lines 170,172,176, which may be one single electrical line, in order that the energy storage device 145 may be charged by the generator 140. Accordingly, the A/C system 100, unlike the A/C system 2 (FIG. 1), is advantageously configured to deliver cool and low-pressure air to an environment and simultaneously (e.g., at the same time) deliver electric power to electrical apparatuses, including the air compressor motor 119, the energy storage device 145, and/or the electrical apparatus 180.

Continuing to refer to FIG. 2, the air compressor 110 includes the inlet 111 for receiving the ambient air, and the inlet 137 of the blower is configured to receive the expanded and cooled air from the second outlet 134 of the turboexpander 120. Furthermore, as shown in FIG. 2, the A/C system 100 further includes a recirculation conduit 139 fluidly coupled to each of the second outlet 134 of the turboexpander 120, the inlet 137 of the blower 150, and the inlet 111 of the air compressor 110 in order to recirculate a first amount of the expanded and cooled air back into the inlet 111 of the air compressor after the first amount has exited the turboexpander 120.

In one example, the air compressor 110 is fluidly coupled between the recirculation conduit 139 and the compressor wheel 124 such that the first amount is configured to flow directly from the recirculation conduit 139 into the inlet 111 of the air compressor 110 to be pressurized before flowing into and being boosted by the compressor wheel 124. In other words, the recirculation conduit 139 is preferably spaced from the inlet 128 associated with the compressor wheel 124.

To illustrate, and with continued reference to FIG. 2, the A/C system 100 may further include a vent conduit 138, as well as a plurality of valves 111-1,137-1,138-1,139-1 each coupled to a corresponding one of the inlet 111 of the air compressor 110, the inlet 137 of the blower 150, the vent conduit 138, and the recirculation conduit 139. The valves 111-1,137-1,138-1,139-1 are preferably each wirelessly connected and/or electrically connected to the control system 190, and function to control the flow of the expanded and cooled air in the system. For example, responsive to actuation of the control system 190, the valve 138-1 may move between fully open and fully closed states, thus causing either large amounts or none, respectively, of the expanded and cooled air to exit the A/C system to an atmosphere via the vent conduit 138. Similarly, the valves 137-1,139-1, 111-1 control airflow into the blower 150, through the recirculation conduit 139, and into the air compressor 110.

In one example, the valves 137-1,139-1 function to control the first amount of the expanded and cooled air flowing into the inlet 111 of the air compressor 110 and a second amount of the expanded and cooled air flowing into the blower 150. In one example, the vent conduit 138 is fluidly coupled to each of the second outlet 134 of the turboexpander 120, the inlet 137 of the blower 150, and the recirculation conduit 139, such that the vent conduit 138 is configured to vent a second amount of the expanded and cooled air to an atmosphere. It will thus be appreciated that the valve 138-1 is configured to control the second amount of the expanded and cooled air being vented to the atmosphere. In one example, responsive to actuation of the control system 190, such as a user pressing a button on the control system 190 or the control system 190 receiving a signal from a smart device (e.g., mobile phone, tablet, vehicle, etc.), the amount of the expanded and cooled air passing through the recirculation conduit 139 may be a predetermined amount.

Continuing to refer to FIG. 2, the air compressor is further configured to startup in a reliable manner. More specifically, the air compressor 110 preferably further includes a vent conduit 117, the outlet 113, a valve 117-1 coupled to the vent conduit 117, and the valve 113-1 coupled to the outlet 113 of the air compressor 110. Furthermore, the vent conduit 117 is configured to vent an amount of the pressurized air to an atmosphere, and the valve 117-1 is configured to control the amount of the pressurized air being vented to the atmosphere. Moreover, the valve 113-1 is configured to control an amount of the pressurized air exiting the air compressor 110 before being delivered to the turboexpander 120. In turn, responsive to the A/C system 100 moving from an INITIAL STATE to an OPERATING state, the amount of pressurized air vented to the atmosphere decreases as the amount of air passing through the outlet 113 increases. Put another way, the vent conduit 117 may close gradually or entirely after the air compressor 110 gets going, in order to allow for maximum delivery of the pressurized air to the turboexpander 120.

Figure 3:
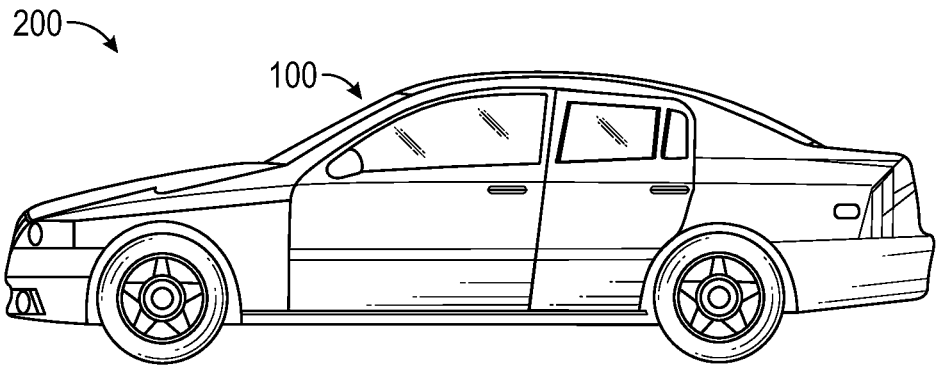
FIGS. 3 and 4 are front and simplified views, respectively, of a transportation system including the A/C system of FIG. 2, in accordance with one non-limiting embodiment of the disclosed concept.
Figure 4:
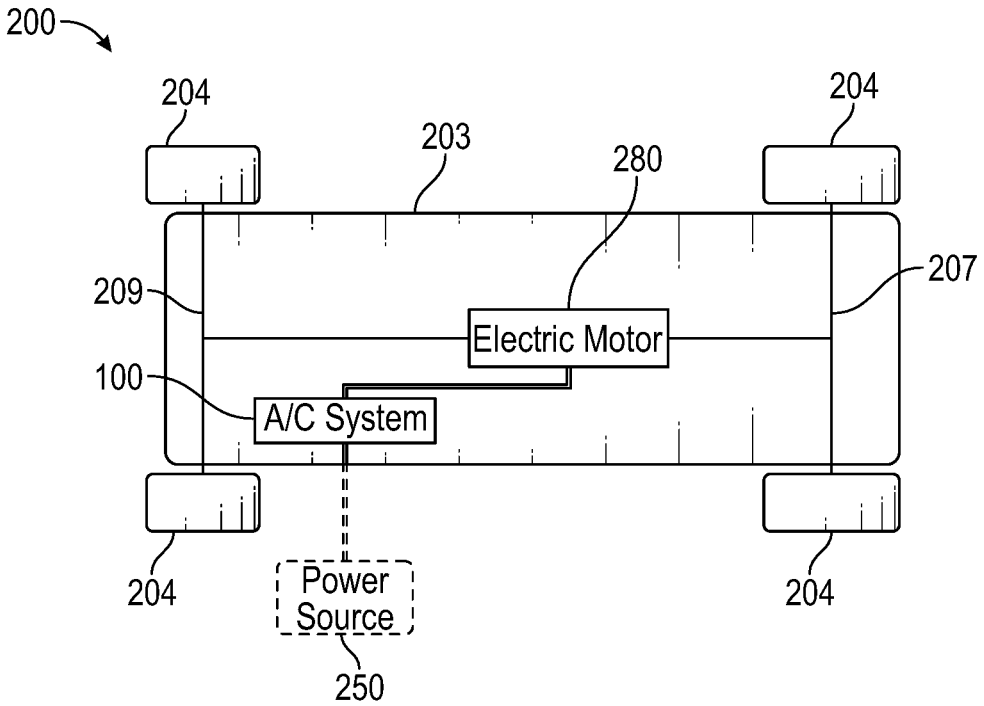

In another example embodiment of the disclosed concept, and as shown in FIGS. 3 and 4, the vehicle 200 includes the A/C system 100, a vehicle body or frame 203, a pair of wheels 204, at least one element (e.g., first and second axles 207,209) each coupled to the frame 203 as well as to one of the pair of wheels 204, and an electrical apparatus in the form of the electric motor 280. In operation the electric motor 280 is configured to drive (e.g., cause to rotate) at least one of the first and second axles 207,209, thereby allowing the first, second, third and fourth wheels 204 to roll when the vehicle 200 is in an OPERATING state. Furthermore, the electric motor 280 is advantageously configured to draw power from each of the generator 140 (FIG. 2) and the energy storage device 145 (FIG. 2).

Continuing to refer to FIG. 4, it will be appreciated that the generator 140 (FIG. 2) and the energy storage device 145 of the A/C system 100 are each electrically connected to and configured to supply power to the electric motor 280. Accordingly, operation of the A/C system 100 as discussed above is configured to deliver cool air to an environment (e.g., a cabin of the vehicle 200) and also generate electric power in the generator 140 in order to charge the energy storage device 145 as well as power the electric motor 280. As the electric motor 280 is powered by the generator 140 and/or the energy storage device 145 (FIG. 2), the body or frame 203 and associated wheels 204 can thus be moved along a road, parking lot, or elsewhere. In other words, the vehicle 200 can be powered and caused to drive by the power from the generator 140 being delivered to the electric motor 280.

Additionally, in the example of FIG. 4 the energy storage device 145 for powering the air compressor motor 119 may be configured to supply power to the electric motor 280 in the form of a backup power supply to the electric motor 280 and/or in order to start the electric motor 280. Accordingly, the generator 140 is configured to power the electric motor 280 and function as a power source during operation of the vehicle 200. As such, the vehicle 200 may be powered with either relatively little electric charging and/or filling up of a gas tank (for hybrid vehicles). That is, the generator 140 may significantly supplement the power capabilities of the vehicle 200.

More specifically, the vehicle 200 may have an OFF state corresponding to the vehicle 200 being turned off and not moving, an IDLING state corresponding to the vehicle 200 being turned on and not moving, and an OPERATING state corresponding to the vehicle 200 being turned on and moving. In one example, the electric motor 280 is configured to draw a first amount of power from the energy storage device 145 (FIG. 2) in order to move the vehicle 200 from the OFF state to the IDLING state. That is, the energy storage device 145 can get the vehicle 200 started, and then once the vehicle 200 is running, the generator 140 (FIG. 2) can charge the energy storage device 145 (FIG. 2) as well as power the electric motor 280.

For example, when the vehicle 200 is in the OPERATING state, the electric motor 280 is configured to draw a second amount of power from the generator 140 (FIG. 2). In other words, the electric motor 280 may draw power from each of the energy storage device 145 and the generator 140, and the generator 140 may be configured to power and charge the energy storage device 145 during operation of the A/C system 100. It will also be appreciated that when the vehicle 200 moves from the IDLING state to the OPERATING state, the first amount of power from the energy storage device 145 decreases as the second amount of power from the generator 140 increases.

Accordingly, the vehicle 200 is configured such that the energy storage device 145 may be employed to start the vehicle 200, and during operation of the vehicle 200, more power may be drawn from the generator 140 than the energy storage device 145. As such, when the vehicle 200 is in the OPERATING state, the first amount of power from the energy storage device 145 is configured to be less than the second amount of power from the generator 140. As a result, the energy storage device 145 may be substantially smaller than batteries associated with today's electric and hybrid vehicles, wherein these batteries (not shown) are typically required to be relatively large and expensive because they are mostly the sole power sources for the vehicles.

Furthermore, by employing the A/C system 100 in the vehicle 200, a tremendous cost and material savings to businesses and consumers can be realized. More specifically, known transportation systems which employ relatively large batteries can advantageously be provided with the relatively small energy storage device 145 instead, due to the generator 140 harnessing energy from the air. As a result, the cost of the vehicle 200 can be relatively low, and the vehicle 200 can also operate in a clean-energy manner wherein material use associated with batteries can be largely minimized.

More specifically, in one example the air compressor 110 is configured to pull in ambient air having a first amount X1 of energy, the air compressor 110 is configured to add a second amount X2 of energy to the ambient air that is being pressurized therein via compression, and during expansion of the air in the expander wheel 126, energy is removed from the air, such that the expanded and cooled air may be generated for air conditioning. Simultaneously, the expander wheel 126 is configured to create mechanical work in the generator 140 in order to generate electricity for powering the air compressor 110 and/or an electrical apparatus (e.g., the electrical apparatus 180 or the electric motor 280). As a result, apart from any friction associated losses in the system, a first fraction of the (X1+X2) energy may be provided as the expanded and cooled air for air conditioning, and a second fraction, which may be a larger fraction, of the (X1+X2) energy may be routed back from the generator 140 in the form of electricity to the air compressor motor 119, the energy storage device 145, and/or the electric motor 280.

Additionally, because warmer air has more energy than colder air, the air conditioning system 100 preferably further has a heating element (e.g., heating coil 139-2) coupled to the recirculation conduit 139. This is optimal for cold weather conditions. More specifically, the heating coil 139-2 is preferably electrically connected to the generator 140 via the electrical line 178 and is preferably configured to be powered by the generator 140 during operation of the air conditioning system 100. As a result, the vehicle 200 is optimally configured to be powered by the air conditioning system 100 in cold weather, where the energy from the air is relatively low, as well as warm weather, where the energy from the air is relatively high. That is, the expanded and cooled air entering the recirculation conduit 139 after exiting the second outlet 134 may be heated with the heating coil 139-2 as it is passed through the recirculation conduit 139, thus increasing an amount of energy supplied to the turboexpander 120 from the air compressor 110.

Additionally, as shown in FIG. 4, the energy storage device 145 (FIG. 2) of the A/C system 100 may, if the need arises, also be separately charged by connecting the vehicle 200 to a power source 250, which may be a charging station or plug extending from a building to a charging port of the vehicle 200.

It will thus be appreciated that the electric motor 280 may be configured to consume a first amount of power per mile during use, and the generator 140 (FIG. 2) of A/C system 100 may be configured to deliver a relatively large fraction of the first amount of power to the electric motor 280. In one example, the first amount of power consumed by the electric motor 280 is between 150-400 watt-hours per mile (e.g., 0.15-0.4 kWh/mile) during use.

Additionally, by powering the electric motor 280 with the air conditioning system 100, operation of the vehicle 200 can be said to be safer than known methods of powering a vehicle. For example, accidents involving gasoline powered vehicles may result in fuel tanks exploding, accidents involving vehicles powered by relatively large batteries may result in non-dry portions of the relatively large batteries igniting, and more recent but known technologies involving liquid hydrogen to power a vehicle may be dangerous in that liquid hydrogen is often rather difficult to contain and work with. In accordance with the disclosed concept, by way of contrast, the air conditioning system 100 obviates these challenges by powering the vehicle 200, in one example, without an explosion between air (e.g., any of the ambient, pressurized, boosted, and expanded and cooled air) and other gases, liquids, or solids. Rather, the disclosed concept relies on a safe heat exchange between energy in the air and electricity.

Although the disclosed concept has been described in association with the transportation system being in the form of the vehicle 200, which is an automobile, it will be appreciated that suitable alternative transportation systems are within the scope of the disclosed concept, including non-sedan automobiles such as sports-utility-vehicles and trucks, as well as buses, trains, large or small ships, and the like, wherein each of these transportation systems may have an electric motor electrically connected to the A/C system 100, and elements coupled to and configured to be driven by the electric motor.

Accordingly, it will be appreciated that one method of delivering expanded and cooled air to an environment with the A/C system comprises the steps of pulling in ambient air and generating pressurized air from the ambient air, with the air compressor 110; delivering the pressurized air to a turboexpander 120 of the A/C system 100; generating boosted air with the turboexpander from the pressurized air from the air compressor 110; after the boosted air has been generated by the turboexpander 120, generating the expanded and cooled air from the boosted air with the turboexpander 120, and also creating mechanical work in a generator 140 of the air conditioning system 100 which is coupled to the turboexpander 120, in order to generate electricity for powering the air compressor 110 and/or an electrical apparatus 180; and at the blower 150, receiving the expanded and cooled air from the turboexpander 120 and delivering the expanded and cooled air to the environment.

It will also be appreciated that the method may further comprise providing with the air compressor 110 the inlet 111 for receiving the ambient air; providing with the turboexpander 120 the outlet 134 through which the expanded and cooled air exits the turboexpander 120; providing with the blower 150 an inlet for receiving the expanded and cooled air from the outlet 134 of the turboexpander 120; and providing the A/C system with a recirculation conduit 139 fluidly coupled to each of the outlet 134 of the turboexpander 120, the inlet 137 of the blower 150, and the inlet 111 of the air compressor 110; and recirculating a first amount of the expanded and cooled air back into the inlet 111 of the air compressor 110 after the first amount has exited the turboexpander 120. The method may further include powering the operating system (e.g., the electrical apparatus 180) of a building with the generator 140 while the blower 150 is delivering the expanded and cooled air to the interior of the building.

Referring again to FIG. 2, and also FIGS. 3 and 4 which include the A/C system 100, additional operation of the A/C system 100 will now be described. In one example, it will be appreciated that the compressor wheel 124 is coupled to the drive shaft 122 and is fluidly coupled to the air compressor 110 such that the pressurized air from the air compressor 110 is configured to be forced through a conduit 112 (e.g., wherein the conduit 112 includes the outlet 113 and the inlet 128, and may be a pipe, such as a closed pipe or continuous closed pipe, which has one single lumen extending from a first open end to a second open end) extending between the air compressor 110 and the compressor wheel 124, and into the compressor wheel 124, thereby providing a source of kinetic energy, optionally a sole source of kinetic energy, to directly cause the compressor wheel 124 to rotate and generate the boosted air from the pressurized air.

The conduit 112 is different than arrangements of known technologies in that it allows for the pressurized air to provide this source of kinetic energy. In accordance with the disclosed concept, the conduit 112 advantageously is configured to receive at least 98 percent of the pressurized air therethrough for delivery to the compressor wheel 124. Additionally, the air compressor 110 may be configured to discharge the pressurized air at a first pressure, and the pressurized air is preferably configured to be received at the compressor wheel 124 at a second pressure equal to at least 95 percent of the first pressure (e.g., due to the conduit 112). Furthermore, and continuing to refer to FIG. 2, the expander wheel 126 is preferably coupled to the drive shaft 122 and fluidly coupled to both the compressor wheel 124 and the blower 150 such that the boosted air from the compressor wheel 124 is configured to be received in the expander wheel 126 and directly cause the expander wheel 126 and the drive shaft 122 to rotate together with the compressor wheel 124 (e.g., the drive shaft 122 and the wheels 124,126 all rotate at the same angular velocity), thereby generating expanded and cooled air in the expander wheel 126.

It will also be appreciated that the air conditioning system is configured such that the expander wheel 126 and the drive shaft 122 rotate together with the compressor wheel 124 via the pressurized air, and the mechanical work is created in the generator 140, without the turboexpander 120 being driven by a combustion reaction involving burning of fuel by an apparatus directly connected to the turboexpander 120 or by an apparatus indirectly connected thereto via intermediate components. For example, the pressurized air is configured to provide the source of kinetic energy to directly cause the compressor wheel 124 to rotate and generate the boosted air from the pressurized air without the pressurized air being mixed with fuel from a combustion reaction before being received in the turboexpander 120. As a result, it is contemplated that all of the pressurized, boosted, and expanded and cooled air are non-toxic to humans and are thus breathable. This is distinct from many known technologies employing turboexpanders, such as in airplanes, in which air is mixed with fuel for directly or indirectly driving the turboexpander. Additionally, it will be appreciated that the turboexpander 120 of the air conditioning system 100 is preferably not configured to be driven by any gases other than air.

Additionally, as stated above, the expander wheel 126 is configured to create mechanical work in the generator 140 responsive to rotation of the drive shaft 122 in order to generate electricity for charging the energy storage device 145 and thereby powering at least one of the air compressor motor 119 and a separate electrical apparatus (e.g., the electric motor 280). Thus, the energy storage device 145 is configured to be charged by recycled energy from both the energy storage device 145 and the ambient air after the ambient air has been pressurized by the air compressor 110 and boosted by the compressor wheel 124.

Additionally, in one example the A/C system 100 includes desirable apparatus to allow the A/C system 100 to operate at relatively low temperatures. These apparatus include the moisture separator 114, discussed above, and a carbon dioxide removal system ("CO2 RS") 116, The moisture separator 114 is fluidly coupled to the conduit 112 and is configured to remove moisture from the pressurized air before the pressurized air is delivered to the compressor wheel 124, thereby allowing the A/C system 100 to generate the expanded and cooled air at a temperature below a freezing temperature of water. Moreover, the carbon dioxide removal system 116 is preferably coupled to the conduit 112 after the moisture separator 114 and is configured to remove carbon dioxide from the pressurized air after the moisture has been removed by the moisture separator 114, and before the pressurized air is delivered to the compressor wheel 124, thereby allowing the A/C system 100 to generate the expanded and cooled air at another temperature below a freezing temperature of carbon dioxide. Because the moisture separator 114 and the carbon dioxide removal system 116 are uniquely configured to allow the expanded and cooled air to exit the expander wheel 126 at low temperatures, these two elements also advantageously allow the A/C system 100 to operate with a relatively large pressure drop across the expander wheel 126.

Continuing to refer to FIG. 2, it will be appreciated that the A/C system 100 further includes an additional conduit 131, one including the outlet 130 associated with the compressor wheel 124 and the inlet 132 associated with the expander wheel 126, such that the conduit 131, which may be a pipe, preferably has a first open end at the compressor wheel 124, a second open end at the expander wheel 126, and a closed portion extending therebetween such that the pipe has one single lumen extending from at the compressor wheel 124 to at the expander wheel 126. As a result of the conduit 131, the boosted air is allowed to flow directly from the compressor wheel 124 into the expander wheel 130.

Figure 5:
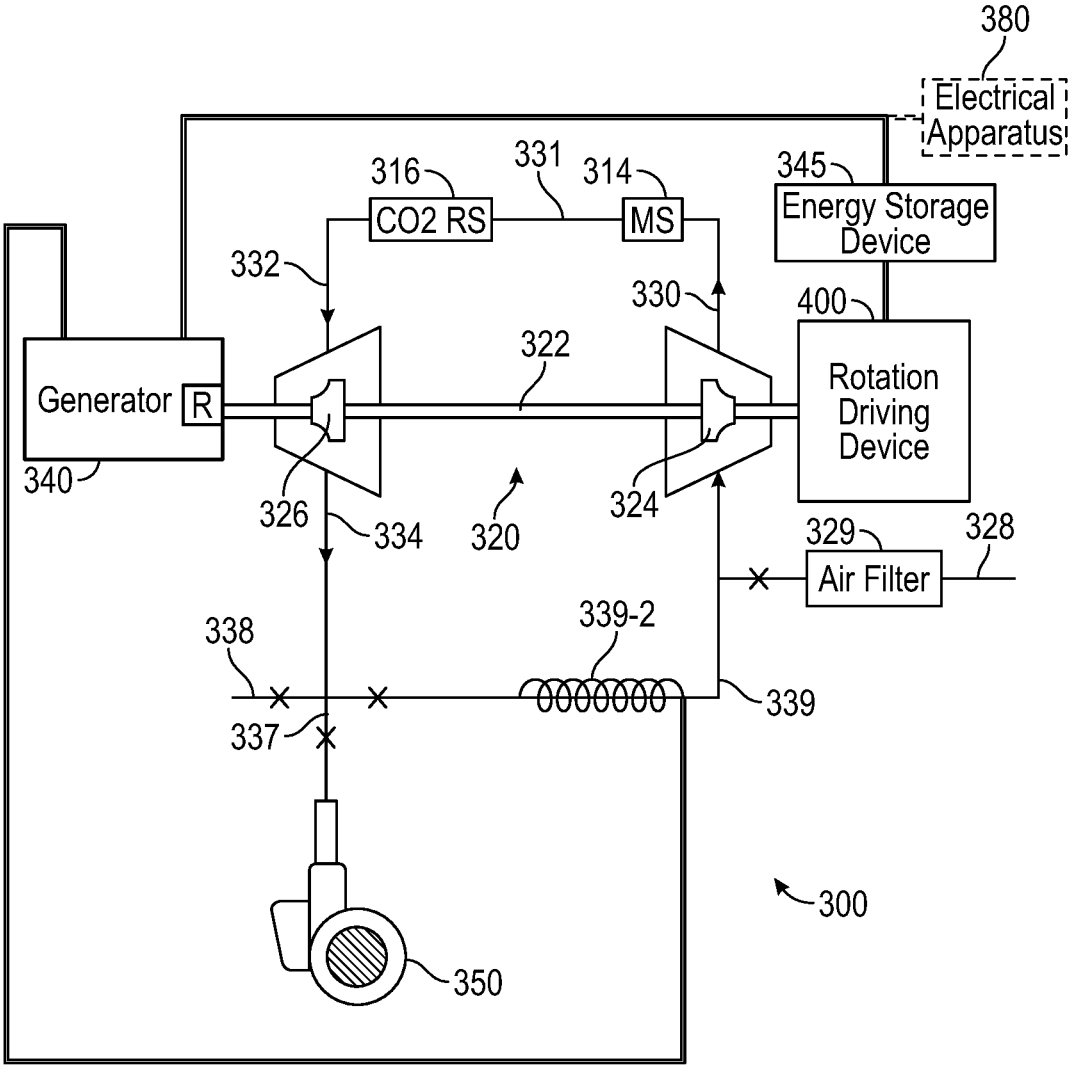
FIG. 5 is a simplified view of another A/C system in accordance with the disclosed concept, wherein double line connections between components in FIG. 5 denote electrical connections and single line connections between components in FIG. 5 generally denote conduits (e.g., without limitation, pipes) through which fluids may flow.

FIG. 5 depicts another A/C system 300 similar to the A/C system 100 (FIG. 2), shown without a vent stack, ductwork, or control system for ease of illustration and economy of disclosure, and wherein like numbers represent like features. For example, the A/C system 300 preferably includes a moisture separator 314, a carbon dioxide removal system 316, a turboexpander 120 (e.g., and drive shaft 322, and associated compressor and expander wheels 324,326 coupled to the drive shaft 322), outlets 330,334, inlets 328,332,337, a vent conduit 338, a recirculation conduit 339, a heating element 339-2, a generator 340, an energy storage device 345 (e.g., without limitation, a battery, a capacitor, or another type of energy storage device), a blower 350, and is configured such that energy storage device 345 may separately charge/power an electrical apparatus 380 (e.g., an electric motor of a transportation system). These elements function in a similar manner as like components described in association with the A/C system 100, and as such, for economy of disclosure, not all functionality of the A/C system 300 will be described herein.

In accordance with the disclosed concept, the A/C system 300 preferably also includes a rotation driving device 400 coupled to the drive shaft 322, and configured to cause (e.g., without limitation, directly cause) the drive shaft 322 to rotate. The rotation driving device 400 preferably engages the drive shaft 322 (e.g., is directly connected thereto), but other arrangements are contemplated (e.g., wherein a suitable alternative rotation driving device is coupled to a suitable alternative drive shaft via a belt). In one example, the drive shaft 322 is a unitary component, optionally made of a single piece of material, and the generator 340 and the rotation driving device 400 may both be directly coupled to the drive shaft 322, and may also be indirectly coupled to the drive shaft 322. As a result of the coupling between the drive shaft 322, the generator 340, and the rotation driving device 400, benefits of the disclosed concept, including efficient operation as caused by imparting of kinetic energy from the rotation driving device 400 to the turboexpander 320, and simultaneous generation of power and air conditioning, are configured to be realized.

Continuing to refer to FIG. 5, the rotation driving device 400 is preferably an electric motor that is configured to be powered by the energy storage device 345, although it will be appreciated herein that alternative rotation driving devices are contemplated. The rotation driving device 400 can be understood as providing a source of kinetic energy to cause the compressor wheel 324 to rotate and generate pressurized air. Further yet, the source of kinetic energy of the rotation driving device 400 (e.g., an electric motor) is configured to cause the expander wheel 326 to rotate together with the compressor wheel 324 independent of an impact of the pressurized air.

When the compressor wheel 324 rotates, it pulls in ambient air via the inlet 328. In other words, the A/C system 300 preferably is configured such that the ambient air is pulled in through the inlet 328, which is associated with the compressor wheel 324 such that the ambient air directly enters the compressor wheel 324. As the ambient air is being pulled in through the inlet 328, the ambient air preferably passes through an air filter 329 (shown in simplified form in FIG. 5) of the A/C system 300 that is coupled to the inlet 328. In this manner, the ambient air preferably enters the compressor wheel 324 at a pressure and temperature that is the same as the pressure and temperature of the ambient air at a distal end of the inlet 328 where the ambient air first enters the A/C system 300.

In the example of FIG. 5, the inlet 328, which preferably has a valve on it (shown but not labeled), is configured to be in an open state, thereby allowing the ambient air to be received therethrough, and passed into the compressor wheel 324. As such, unlike the A/C system 100 (FIG. 2) in which the air compressor 110 (FIG. 2) pulls in ambient air, in the A/C system 100 (FIG. 2) the compressor wheel 324 is configured to pull in ambient air and generate pressurized air from the ambient air responsive to rotation of the drive shaft 322 (e.g., as caused by the rotation driving device 400).

Figure 6:
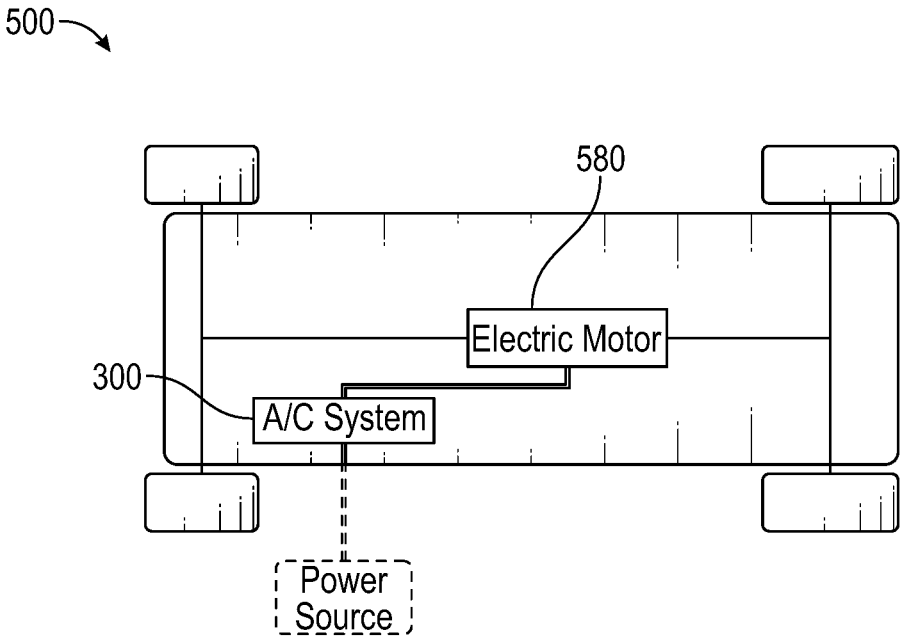
FIG. 6 is a simplified view of a transportation system including the A/C system of FIG. 5, in accordance with one non-limiting embodiment of the disclosed concept.

As such, the A/C system 300 subsequently works as follows. The expander wheel 326, which is coupled to the drive shaft 322 and fluidly coupled to the compressor wheel 324, is configured such that the pressurized air from the compressor wheel 324 is configured to be received in the expander wheel 326 and converted into expanded and cooled air by the expander wheel 326 for delivery to an environment. Furthermore, the expander wheel 326 and the generator 340 (e.g., which is electrically connected to the energy storage device 345) are configured to convert both the source of kinetic and energy in the ambient air into mechanical energy of the drive shaft 322, and then convert the mechanical energy of the drive shaft 322 into electrical energy in the generator 340 for charging the energy storage device 345, and thereby powering (e.g., charging) the rotation driving device 400 (e.g., and also the other electrical apparatus 380, which may be an electric motor 580, as shown in FIG. 6).

Accordingly, the rest of the A/C system 300, as discussed above, functions similar to the A/C system 100 (FIG. 2). That is, the turboexpander 320 does not rotate due to a combustion reaction involving burning of fuel by an apparatus indirectly connected to the turboexpander 320 via intermediate components, and the turboexpander 320 does not rotate due to a combustion reaction involving burning of fuel by an apparatus directly connected to the turboexpander 320. Additionally, the source of kinetic energy applied to the drive shaft 322 by the rotation driving device 400 may be a sole source of kinetic energy to directly cause the compressor wheel 324 to rotate, the A/C system 300 is preferably a coolant-free A/C system 300 like the A/C system 100 (FIG. 2), and the energy storage device 345 is preferably configured to be charged by recycled energy from both the energy storage device 345 and the energy in the ambient air after the ambient air has been pressurized by the compressor wheel 324. The conduit 331, which is fluidly coupled to the compressor wheel 324 and the expander wheel 326, preferably extends from at the compressor wheel 324 to at the expander wheel 326, thus allowing the pressurized air to flow directly from the compressor wheel 324 into the expander wheel 326, and the conduit 331 may include a pipe having a first open end at the compressor wheel 324, a second open end at the expander wheel 326, and a closed portion extending therebetween such that the pipe has a single lumen extending between the first and second open ends.

However, unlike the A/C system 100 (FIG. 2), the A/C system 300 is configured with different positioning for the moisture separator 314 and the carbon dioxide removal system 316, namely because the A/C system 300 is preferably devoid of an air compressor other than the compressor wheel 324. That is, the compressor wheel 324 may be configured to act as a sole air compressor for the A/C system 300. As such, the moisture separator 314 is preferably fluidly coupled to the conduit 331 and configured to remove moisture from the pressurized air before the pressurized air is delivered to the expander wheel 326, thereby allowing the A/C system 300 to generate the expanded and cooled air at a temperature below a freezing temperature of water. Additionally, the carbon dioxide removal system 316 is preferably fluidly coupled to the conduit 331 after the moisture separator 314 and is configured to remove carbon dioxide from the pressurized air after the moisture has been removed by the moisture separator 314 and before the pressurized air is delivered to the expander wheel 326, thereby allowing the A/C system 300 to generate the expanded and cooled air at a temperature below a freezing temperature of carbon dioxide.

Moreover, as the A/C system 300 is preferably devoid of a separate air compressor other than the compressor wheel 324, the recirculation conduit 339 is configured differently than in the A/C system 100 (FIG. 2). For example, the recirculation conduit 339 is preferably configured to discharge directly into the compressor wheel 324.

More specifically, as shown in FIG. 4, the blower 350 is fluidly coupled to the expander wheel 326 and configured to receive the expanded and cooled air from the expander wheel 326 and deliver the expanded and cooled air to an environment. The inlet 328 associated with the compressor wheel 324 is configured to receive the ambient air before the ambient air is pulled into the compressor wheel 324. Additionally, the recirculation conduit 339 is preferably fluidly coupled to each of the outlet 334 of the turboexpander 320, the inlet 337 of the blower 350, and the inlet 328 associated with the compressor wheel 324 in order to recirculate a first amount of the expanded and cooled air back into the inlet 328 associated with the compressor wheel 324 after the first amount has exited the turboexpander 320.

FIG. 6 is an example transportation system 500, according to one embodiment of the disclosed concept. The transportation system 500 is configured similar to the transportation system 200 (FIG. 4), and like numbers represent like features. Specifically, the transportation system 500 includes an electric motor 580, at least one element (shown but not labeled) coupled to and configured to be driven by the electric motor 580 in order to move the transportation system 500 between an IDLING state corresponding to the transportation system 500 being turned on and not moving, and an OPERATING state corresponding to the transportation system 500 being turned on and moving. Additionally, the transportation system 500 preferably also includes the A/C system 300, wherein the energy storage device 345 (FIG. 5) of the A/C system 300 may be a primary energy storage device, such as a battery, of the transportation system 500. In this manner, the transportation system 500 can be understood as including a plurality of different rotation driving devices (e.g., the rotation driving device 400, which may be an electric motor, and the electric motor 580), each of which may be powered by the energy storage device 345, and wherein the generator 340 may be configured to recharge the energy storage device 345 with recycled energy from both the energy storage device 345 and additional energy in the ambient air.

Accordingly, it will be appreciated that one method of delivering expanded and cooled air to an environment with the A/C system 300 comprises the steps of pulling in ambient air and generating pressurized air from the ambient air, with the air compressor wheel 324 of the turboexpander 320; delivering the pressurized air to the expander wheel 326 via the conduit 331; generating expanded and cooled air from the pressurized air with the expander wheel 326, and also creating mechanical work in the generator 340, in order to generate electricity for powering the rotation generating device 400 and/or the electrical apparatus 380 (e.g., via the energy storage device 345); and optionally, at the blower 350, receiving the expanded and cooled air from the turboexpander 320 and delivering the expanded and cooled air to the environment.

While the present disclosure has been described with reference to various implementations, it will be understood that these implementations are illustrative and that the scope of the disclosure is not limited to them. Many variations, modifications, additions, and improvements are possible. More generally, implementations in accordance with the present disclosure have been described in the context of particular implementations. Functionality can be separated or combined in blocks differently in various implementations of the disclosure or described with different terminology. These and other variations, modifications, additions, and improvements can fall within the scope of the disclosure as defined in the claims that follow.

What is claimed is:

1. An air conditioning system, comprising:

a rotation driving device; and a turboexpander, comprising:

a drive shaft coupled to the rotation driving device, and configured to be rotated by the rotation driving device, a compressor wheel coupled to the drive shaft and configured to receive first air and generate second air from the first air in a manner wherein the rotation driving device provides a source of kinetic energy to cause the compressor wheel to rotate and pressurize the first air, and an expander wheel coupled to the drive shaft such that the source of kinetic energy is configured to cause the expander wheel to rotate together with the compressor wheel, wherein the expander wheel is fluidly coupled to the compressor wheel, thereby allowing the second air from the compressor wheel to be received in the expander wheel and, responsive to energy being removed from the second air, converted into third, expanded and cooled air by the expander wheel for delivery to an environment.

2. The air conditioning system according to claim 1, wherein the rotation driving device is an electric motor.

3. The air conditioning system according to claim 2, wherein the turboexpander does not rotate due to a combustion reaction involving burning of fuel by an apparatus indirectly connected to the turboexpander via intermediate components, and wherein the turboexpander does not rotate due to a combustion reaction involving burning of fuel by an apparatus directly connected to the turboexpander.

4. The air conditioning system according to claim 2, wherein the electric motor engages the drive shaft.

5. The air conditioning system according to claim 2, further comprising a moisture separator, a carbon dioxide removal system, and a conduit, wherein the conduit is fluidly coupled to the compressor wheel and the expander wheel, wherein the moisture separator is fluidly coupled to the conduit and configured to remove moisture from the second air before the second air is delivered to the expander wheel, thereby allowing the air conditioning system to generate the third, expanded and cooled air at a temperature below a freezing temperature of water, and wherein the carbon dioxide removal system is fluidly coupled to the conduit after the moisture separator and is configured to remove carbon dioxide from the second air after the moisture has been removed by the moisture separator and before the second air is delivered to the expander wheel, thereby allowing the air conditioning system to generate the third, expanded and cooled air at a temperature below a freezing temperature of carbon dioxide.

6. The air conditioning system according to claim 2, further comprising an inlet associated with the compressor wheel, a recirculation conduit, and a blower, wherein the blower is fluidly coupled to the expander wheel and configured to receive the third, expanded and cooled air from the expander wheel and deliver the third, expanded and cooled air to the environment, wherein the turboexpander further comprises an outlet through which the third, expanded and cooled air exits the expander wheel, wherein the blower has an inlet for receiving the third, expanded and cooled air from the outlet of the turboexpander, wherein the recirculation conduit is fluidly coupled to each of the outlet of the turboexpander, the inlet of the blower, and the inlet associated with the compressor wheel in order to recirculate a first amount of the third, expanded and cooled air back into the inlet associated with the compressor wheel after the first amount has exited the turboexpander.

7. The air conditioning system according to claim 1, further comprising a conduit comprising an outlet associated with the compressor wheel and an inlet associated with the expander wheel, such that the conduit extends from at the compressor wheel to at the expander wheel, thus allowing the second air to flow directly from the compressor wheel into the expander wheel.

8. The air conditioning system according to claim 7, wherein the air conditioning system is a coolant-free air conditioning system.

9. The air conditioning system according to claim 8, wherein the turboexpander does not rotate due to a combustion reaction involving burning of fuel by an apparatus indirectly connected to the turboexpander via intermediate components, and wherein the turboexpander does not rotate due to a combustion reaction involving burning of fuel by an apparatus directly connected to the turboexpander.

10. The air conditioning system according to claim 7, wherein the conduit comprises a pipe having a first open end at the compressor wheel and a second open end at the expander wheel such that the pipe has a single lumen extending between the first and second open ends.

11. The air conditioning system according to claim 7, wherein the second air is configured to exit the compressor wheel at a first temperature and enter the expander wheel at a second temperature substantially the same as the first temperature.

12. The air conditioning system according to claim 1, further comprising an energy storage device for powering the rotation driving device, and a generator electrically connected to the energy storage device, wherein the drive shaft is coupled to the generator, and wherein the expander wheel and the generator are configured to convert both the source of kinetic energy and energy in the first air into mechanical energy of the drive shaft, and then convert the mechanical energy of the drive shaft into electrical energy in the generator for charging the energy storage device, and thereby powering the rotation driving device.

13. A transportation system, comprising:

an electric motor;

at least one element coupled to and configured to be driven by the electric motor in order to move the transportation system between an IDLING state corresponding to the transportation system being turned on and not moving, and an OPERATING state corresponding to the transportation system being turned on and moving; and air conditioning system, comprising:

a rotation driving device, an energy storage device for powering both the rotation driving device and the electric motor, a generator electrically connected to the energy storage device, and a turboexpander, comprising:

a drive shaft coupled to both the generator and the rotation driving device, and configured to be rotated by the rotation driving device, a compressor wheel coupled to the drive shaft and configured to receive first air and generate second air from the first air in a manner wherein the rotation driving device provides a source of kinetic energy to cause the compressor wheel to rotate and pressurize the first air, and an expander wheel coupled to the drive shaft such that the source of kinetic energy is configured to cause the expander wheel to rotate together with the compressor wheel, wherein the expander wheel is fluidly coupled to the compressor wheel, thereby allowing the second air from the compressor wheel to be received in the expander wheel and, responsive to energy being removed from the second air, converted into third, expanded and cooled air by the expander wheel for delivery to an environment, and wherein the expander wheel and the generator are configured to convert both the source of kinetic energy and energy in the first air into mechanical energy of the drive shaft, and then convert the mechanical energy of the drive shaft into electrical energy in the generator for charging the energy storage device, and thereby powering the rotation driving device.

14. The transportation system according to claim 13, wherein the electric motor is a first electric motor, and wherein the rotation driving device is a second electric motor.

15. The transportation system according to claim 14, wherein the at least one element comprises a first axle and a second axle, wherein the transportation system further comprises a first pair of wheels coupled to the first axle, and a second pair of wheels coupled to the second axle, and wherein the first electric motor is coupled to and configured to drive the first and second axles, thereby allowing the first and second pairs of wheels to roll when the transportation system is in the OPERATING state.

16. The transportation system according to claim 14, wherein the turboexpander does not rotate due to a combustion reaction involving burning of fuel by an apparatus indirectly connected to the turboexpander via intermediate components, and wherein the turboexpander does not rotate due to a combustion reaction involving burning of fuel by an apparatus directly connected to the turboexpander.

17. The transportation air conditioning system according to claim 14, wherein the second electric motor engages the drive shaft.

* * * * *